US007831162B2

(12) United States Patent
Yamane

(10) Patent No.: US 7,831,162 B2
(45) Date of Patent: Nov. 9, 2010

(54) IMAGE FORMING APPARATUS WITH SURFACE POTENTIAL ADJUSTMENT BASED ON IDLE TIME

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 723 days.

(21) Appl. No.: 11/679,452

(22) Filed: Feb. 27, 2007

(65) Prior Publication Data

US 2007/0223949 A1 Sep. 27, 2007

(30) Foreign Application Priority Data

Mar. 23, 2006 (JP) ..... 2006-080234

(51) Int. Cl.
*G03G 15/02* (2006.01)

(52) U.S. Cl. ..... 399/50

(58) Field of Classification Search ..... 399/43, 399/44, 50, 69, 88, 89
See application file for complete search history.

(56) References Cited

U.S. PATENT DOCUMENTS 4,474,455 A * 10/1984 Hirakura et al.
5,708,915 A * 1/1998 Noguchi et al. ..... 399/49
5,878,298 A * 3/1999 Nakano ..... 399/24

FOREIGN PATENT DOCUMENTS

JP 2000347531 A * 12/2000
JP 2002-169343 A 6/2002

* cited by examiner

*Primary Examiner*—David P Porta
*Assistant Examiner*—Milton Gonzalez
(74) *Attorney, Agent, or Firm*—Panitch Schwarze Belisario & Nadel LLP

(57) ABSTRACT

The present invention is an image forming apparatus containing an image holding body, a developer holding body for holding developer that forms a developer image by being affixed to the electrostatic latent image formed on the image holding body, a transfer unit for transferring the developer image to a medium, a fusion apparatus for fusing the transferred developer image onto the medium, an idle time judgment process section for making a judgment as to whether an idle time, from when printing is completed to when printing is initiated, of the image forming apparatus is long, and a surface potential setting process section for changing and setting a surface potential of the image holding body to a reference value at which fogging is not generated in a case where the idle time is long.

6 Claims, 5 Drawing Sheets

IMAGE FORMING APPARATUS WITH SURFACE POTENTIAL ADJUSTMENT BASED ON IDLE TIME

BACKGROUND OF THE INVENTION

1. Field of the Invention

The present invention relates to an image forming apparatus.

2. Description of Related Art

Conventionally, in image forming apparatuses such as printers, copy machines, fax machines, and multifunction devices, a surface of a photosensitive drum, is charged by a charge roller, an electrostatic latent image is formed by exposing the photosensitive drum with an LED head, a toner image is formed by electrostatically affixing to the electrostatic latent image a thin layer of toner as developer on a development roller, and the toner image is transferred to paper by a transfer roller. The paper onto which the toner image is transferred is sent to a fusion device by which the toner image is fused to the paper.

In the aforementioned printer, toner that cannot be charged until a regular potential (negative polarity) or toner that is charged with reversed polarity (positive polarity) is generated as fogging toner and affixed to the surface of the photosensitive drum (negative polarity) and then to the paper to cause further fogging. To prevent generation of this fogging toner, the surface potential of the photosensitive drum is set to a potential that makes it difficult for fogging toner to be affixed. (see Japanese Patent Application Publication 2002-169343).

However, in conventional printers, generation of fogging cannot reliably be prevented because the amount of fogging toner generated changes according to the idle time of the printer, the environment in the printer is placed, and the like.

SUMMARY OF THE INVENTION

The present invention aims to solve the problems of conventional image forming apparatuses and to provide an image forming apparatus that can reliably prevent the generation of fogging.

To achieve this, the image forming apparatus of the present invention contains an image holding body, a developer holding body for holding developer that forms a developer image by being affixed to the electrostatic latent image formed on the image holding body, a transfer unit for transferring the developer image to a medium, a fusion apparatus for fusing the transferred developer image onto the medium, an idle time judgment process section for making a judgment as to whether an idle time, from when printing is completed to when printing is initiated, of the image forming apparatus is long, and a surface potential setting process section for changing and setting a surface potential of the image holding body to a reference value at which fogging is not generated in a case where the idle time is long.

According to the present invention, the image forming apparatus may also contain an image holding body, a developer holding body for holding developer that forms a developer image by being affixed to the electrostatic latent image formed on the image holding body, a transfer unit for transferring the developer image to a medium, a fusion apparatus for fusing the transferred developer image onto the medium, and a surface potential changing unit for changing the surface potential before the surface potential reaches a point at which fogging is generated.

In a case where the idle time of the image forming apparatus is long, the generation of fogging can reliably be prevented because the surface potential of the image holding unit is changed and set to a reference value at which fogging is not generated.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DESCRIPTION OF THE PREFERRED EMBODIMENTS

First Embodiment

The following is a detailed description referencing diagrams concerning the embodiments of the present invention. In this case, the image forming apparatus is described as relating to a printer.

Figure 2:
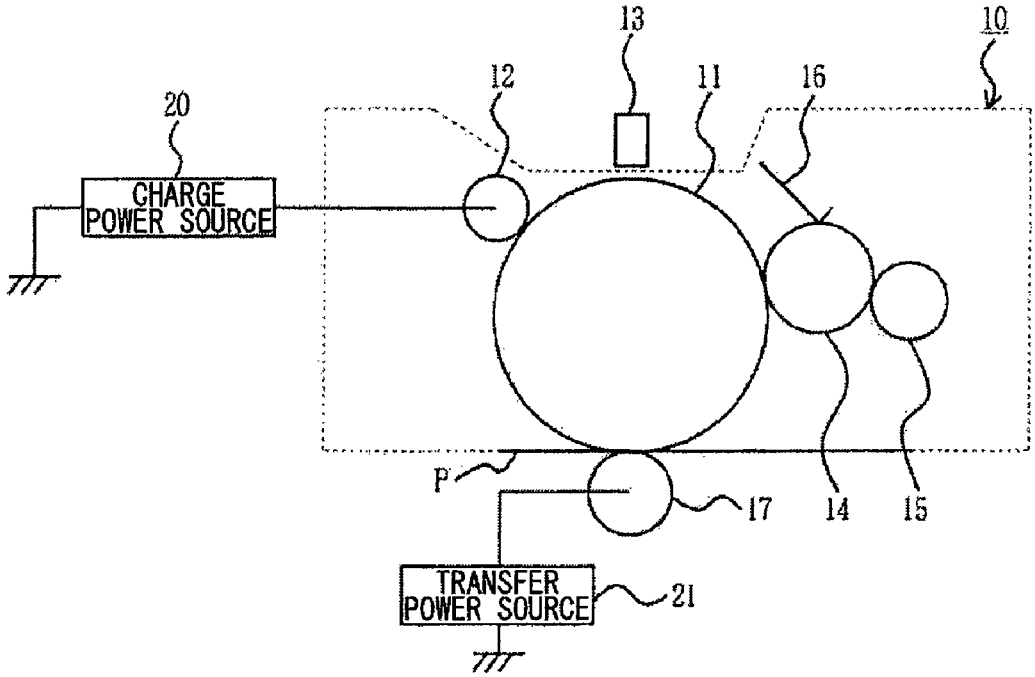
FIG. 2 is a schematic diagram of the printer according to the first embodiment of the present invention.

FIG. 2 is a schematic diagram of the printer according to the first embodiment of the present invention.

As shown in FIG. 2, the printer contains a paper cassette, not shown, serving as a medium storage section for storing printing paper P serving as a medium, a drum cartridge 10, disposed in an attachable and detachable manner to the main body of the printing apparatus and serving as an image formation unit that forms the toner image serving as the developer image, an LED head 13 serving as an exposure apparatus, a transfer roller 17 serving as a transfer section, a fusion device, not shown, serving as a fusion apparatus, and the like.

At an anterior end of the paper cassette, a hopping roller is disposed as a supply roller to separate and supply the papers P one by one to a medium feeding path. The paper P supplied by the hopping roller is fed by a feeding roller and a pinch roller disposed downstream in the medium feeding path from the hopping roller and sent between the drum cartridge 10 and the transfer roller 17.

The drum cartridge 10 makes up the image formation section and contains image formation elements for forming the image such as the photosensitive drum 11 serving as an image holding body, a charge roller 12 serving as a charge device for uniformly and evenly charging the surface of the photosensitive drum 11, a development roller 14 serving as a holding body for the developer that forms the toner image by developing the image by affixing the toner serving as developer to the latent image formed by the exposure using the LED head 13, a toner supply roller 15 serving as a developer supply section for charging and supplying the toner to the charged development roller 14, a development blade 16 serving as a developer regulation section for forming a toner layer as a uniform developer layer on the development roller 14, a cleaning blade, not shown, serving as a cleaning device for recovering the toner remaining on the photosensitive drum 11 after transfer of the toner image, and a toner feeding unit (not shown) serving as a developer feeding unit that feeds the recovered toner into a recovery receptacle, not shown. The charge roller 12, development roller 14, transfer roller 17, and cleaning blade are disposed in a manner directly contacting the photosensitive drum 11.

The LED head 13 that forms the electrostatic latent image by exposing the surface of the photosensitive drum 11 is disposed above the drum cartridge 10, and the transfer roller 17 that transfers the toner image formed on the photosensitive drum 11 onto the paper is disposed below the drum cartridge 10. The fusion device is disposed downstream in the medium feeding path from the drum cartridge 10 and the transfer roller 17. The fusion device contains a heat roller as a first rotating body and a pressure roller as a second rotating body.

The photosensitive drum 11 is made up of a conductive support body and a photoconductive layer, and is defined as an organic photosensitive body that is formed by sequentially layering a charge generation layer and a charge conveyance layer as the photoconductive layer on an aluminum metal pipe serving as the conductive support body. In addition, the charge roller 12 is made up of a metallic shaft and a semiconductive rubber layer, and the development roller 14 is made up of a metallic shaft and a semiconductive urethane rubber layer or the like.

The development blade 16 is made up of, for example, a thin board with a thickness of 0.8 mm and a longitudinal length approximately equal to the outer diameter of the developer roller 14. A longitudinal edge of the development blade 16 is affixed to a frame, not shown, and the surface slightly inwards from the tip directly contacts the development roller 14.

Further, numeral 20 is a charge power source for supplying voltage to the charge roller 12, and numeral 21 is a transfer power source for supplying voltage to the transfer roller 17. When voltage is applied to the charge roller 12 by the charge power source 20, the charge roller 12 charges the surface of the photosensitive drum 11 to form a surface potential v0.

Next, the performance of the printer having the aforementioned structure will be described.

First, the surface of the photosensitive drum 11 is charged to an arbitrary polarity and potential by the charge roller 12. When the image data is sent from a control unit, not shown, to the LED head 13, the LED head 13 generates an LED light, thereby irradiating the surface of the photosensitive drum 11 and forming the electrostatic latent image. The toner supply roller 15 directly contacts the development roller 14 and supplies toner to the development roller 14 by rotating. The toner on the development roller 14 is charged by friction occurring with the development blade 16. In addition, the thickness of the toner layer on the development roller 14 is determined by the pressure exerted on the development roller 14 by the development blade 16.

Further, the development roller 14 directly contacts the photosensitive drum 11 and the toner is affixed to the electrostatic latent image on the photosensitive drum 11 by the application of voltage, thereby forming the toner image. Next, the toner image on the photosensitive drum 11 is transferred to the paper P by the transfer roller 17 and the toner image on the paper P is fused by the fusion device. In addition, the toner remaining on the photosensitive drum 11 after transfer is removed by the cleaning blade.

In the printer, when toner that cannot be charged until a regular potential (negative polarity) or toner that is charged with reversed polarity (positive polarity) is generated as fogging toner and affixed to the surface of the photosensitive drum (negative polarity), causing fogging by affixing the fogging toner to the paper P. On the other hand, the toner charged with a regular potential (negative polarity) is affixed to the surface of the photosensitive drum 11 (negative polarity), thereby affixing more toner to the paper P and causing blurs in the development.

Next, the amount of fogging generated when printing is executed, in other words, the change of the fogging level, will be described.

Figure 3:
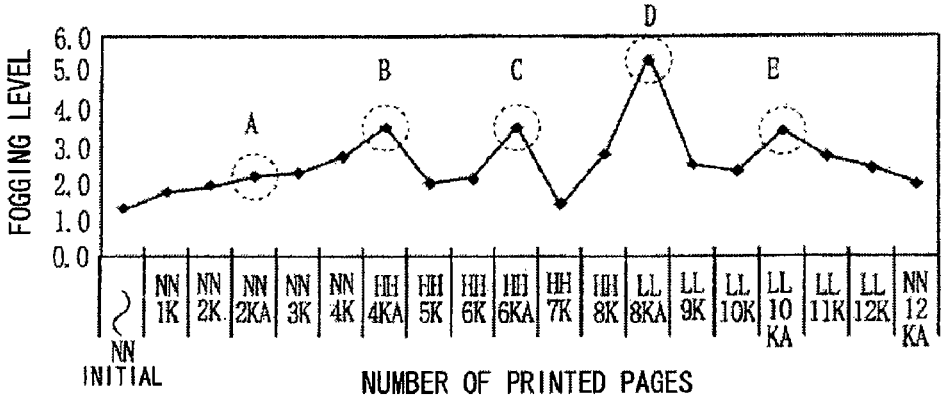
FIG. 3 is a diagram showing the change of a fogging level.

FIG. 3 is a diagram showing the change of the fogging level. In the graph shown in FIG. 3, the horizontal axis represents the number of pages printed and the vertical axis represents the fogging level.

In FIG. 3, the letter K is a unit indicating 1000 printed pages, so 1K represents 1000 pages and 2K represents 2000 pages, for example. Further, the letter A following the letter K represents a condition where the printer is idle for a long period of time, a day or two for example, after printing is executed. For example, 2KA represents a condition where the printer has been idle since printing 2K (2000 pages) and 4KA represents a condition where the printer has been idle since printing 4K (4000 pages).

Further, NN, HH, and LL indicate that the environment in which the printer is placed is of normal temperature and normal humidity, high temperature and high humidity, and low temperature and low humidity, respectively. In this case, NN represents a temperature of 25 degrees Celsius and a humidity of 50%, HH represents a temperature of 28 degrees Celsius and a humidity of 80%, and LL represents a temperature of 10 degrees Celsius and a humidity of 20%.

As shown in FIG. 3, points A, B, C, D, and E are fogging levels relating to a first printing after the printer has been idle for a long period of time. From this it is understood that the fogging level is high and a greater amount of fogging is generated after the printer is idle for a long period of time.

Figure 4A:
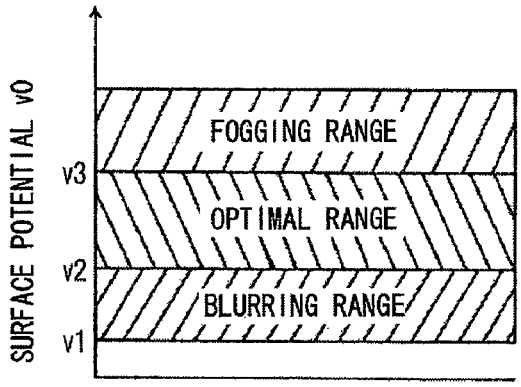
FIG. 4A is a diagram showing a condition of the fogging generated on the surface of a photosensitive drum 11.

FIG. 4A is a diagram showing a condition of the fogging generated on the surface of the photosensitive drum 11. In FIG. 4A, the vertical axis represents the surface potential v0 of the photosensitive drum 11.

In this case, a printer executing reversal development in which the toner is charged with a negative polarity will be described. Because the surface potential v0 is a negative value, each potential from v1 to v3 also has a negative value and therefore the relationship between the surface potential v0 and the potentials v1 to v3 are described in terms of a negative direction.

In FIG. 4A, v1 is the potential resulting from the addition of the potential of the toner layer on the development roller 14 to the voltage applied to the development roller 14, v2 is the minimum potential necessary to prevent the formation of blurring on the surface of the photosensitive drum 11, and v3 is the maximum potential necessary to prevent fogging on the surface of the photosensitive drum 11. Accordingly, with respect to the surface potential v0, the range of v1≦v0≦v2 falls in the blurring area in which the toner on the development roller 14 is affixed to the surface of the photosensitive drum 11. Further, range of v0<v3, v0 falls in the fogging area in which fogging is generated.

Figure 4B:
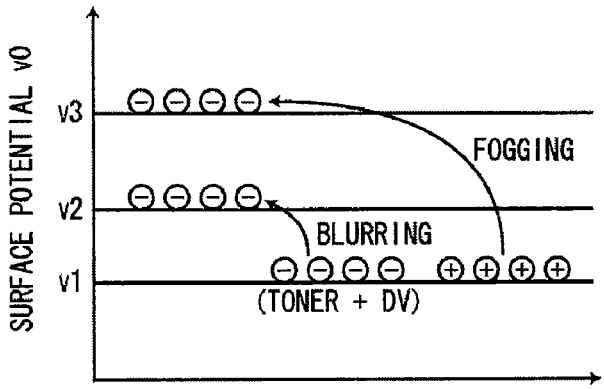
FIG. 4B is a diagram showing a potential resulting from application of a toner potential on a development roller to a voltage applied to the development roller.

The range of the surface potential of v2≦v0≦v3 indicates the favorable area in which fogging is not generated and the toner on the development roller 14 is not affixed to the surface of the photosensitive drum 11. Here, FIG. 4B will be used to describe FIG. 4A in an easily understandable manner. In FIG. 4B, (toner +DV) represents the potential resulting from the addition of the toner potential on the development roller 14 to the voltage applied to the development roller 14. The meanings of v1, v2, and v3 are the same as in FIG. 4A. The charges—symbols above v2 and v3 indicate that the charges of the photosensitive drum 11 serving as the image holding body have negative polarity, and the—+++symbols above v1 indicate toner charged with a negative polarity and toner charged with a reversed polarity (positive polarity). When the surface potential v0 of the photosensitive drum 11 is greater than v3, the toner charged with positive polarity on the development roller 14 becomes easily affixed to the photosensitive drum 11, causing fogging. On the other hand, when the surface potential v0 of the photosensitive drum 11 is less than v2, the toner charged with negative polarity on the development roller 14 becomes easily affixed to the photosensitive drum 11, causing blurring.

However, there is a tendency for the potential of the toner layer that makes up the potential v1 to be lowered when the printer is idle for a long period of time, which results in a lowering of the potential v3, which is the maximum potential necessary to prevent fogging, and also causes the surface potential v0 to enter into the fogging area, generating fogging in such a case.

In the present embodiment, in a case where the printer is idle for a prescribed period of time, the setting for the surface potential v0 of the photosensitive drum 11 is lowered, thereby preventing the generation of fogging.

Figure 1:
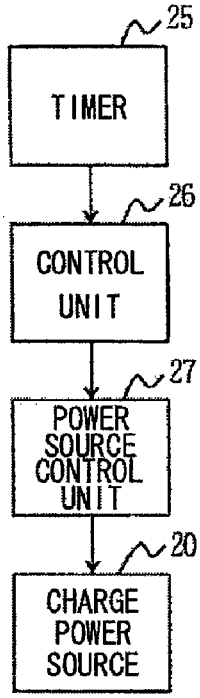
FIG. 1 is a block diagram showing the controls of the printer according to a first embodiment of the present invention.

FIG. 1 is a block diagram showing the controls of the printer relating to the first embodiment of the present invention.

In FIG. 1, numeral 20 is the charge power source, numeral 26 is a control unit, and numeral 27 is a power source control unit for applying voltage to the charge power source 20. Further, numeral 25 is a timer serving as a timing section for measuring the period of time for which the printer is idle. An idle time calculation process section, not shown, of the control unit 26 executes an idle time calculation process to order the timer 25 to measure the time, to read the time measured by the timer 25, and to calculate the time period for which the printer is idle. In addition, a surface potential setting process section, not shown, of the control unit 26 executes a surface voltage setting process to set the surface potential v0 and to set the time to apply voltage to the charge power source 20, thereby sending a command to the power source control unit 27. The power source control unit 27 applies voltage to the charge power source 20 in accordance with the command from the control unit 26.

Figure 5:
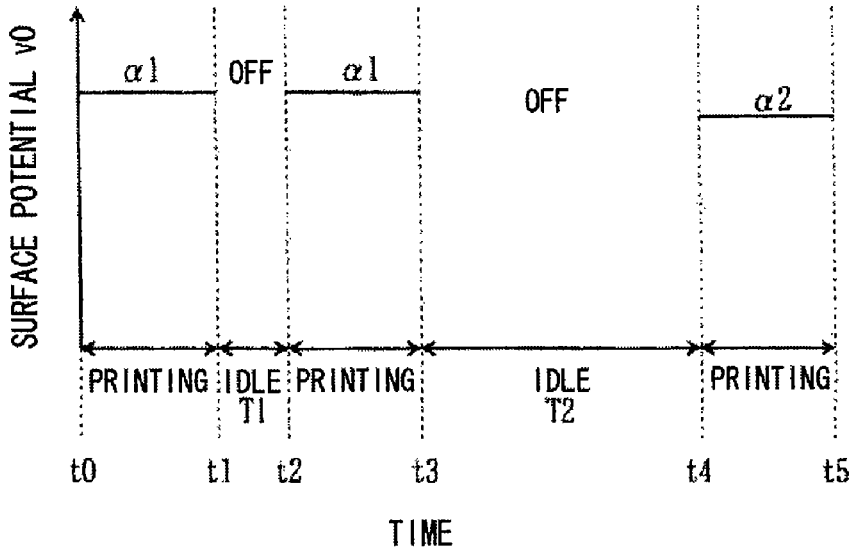
FIG. 5 is a time chart showing the performance of the printer according to the first embodiment of the present invention.

FIG. 5 is a time chart showing the performance of the printer according to the first embodiment of the present invention.

As shown in FIG. 5, in the printing from a time t0 to t1, the surface voltage setting process section sets the surface potential v0 to a reference value α1 and sends a command to the power source control unit 27. In accordance with the command from the surface potential setting process section, the power source control unit 27 applies voltage to the charge power source 20, sets the surface potential v0 of the photosensitive drum 11 to a reference value α1, and executes printing.

Next, printing is completed at a time t1, and the printer is idle if there is no print job sent from an external source such as an upper level apparatus, not shown.

The idle time calculation process section initiates time measurement by the timer 25 and completes the time measurement when printing is initiated at a time t2. T1, which is the time from t1 to t2 when the printer is idle, is then calculated.

Next, an idle time judgment process section, not shown, of the control unit 26 executes an idle time judgment process to make a judgment as to whether the idle time period T1 is long based on whether T1 is above a previously set threshold Tth. In such a case, because the idle time period T1 is shorter than the threshold Tth, the surface potential setting process section sets the surface potential v0 to the reference value α1.

When printing is completed at a time t3 and the printer again becomes idle, the idle time calculation process section initiates time measurement by the timer 25 and completes the time measurement when printing is initiated at a time t4. T2, which is the time from t3 to t4 when the printer is idle, is then calculated.

Next, the idle time judgment process section makes a judgment as to whether the idle time period T2 is above the previously set threshold Tth. In such a case, because the idle time period T2 is greater than the threshold Tth, the surface potential setting process section sets the surface potential v0 to a value α2, which is lower than the reference value α1.

In the present embodiment, when the idle time period of the printer is above the threshold, because the surface potential v0 is set as the value α2 that is lower than the reference value α1, the surface potential v0 does not fall into the fogging area even if the voltage of the toner layer that makes up the potential v1 (FIG. 4A) is lowered, and v3, which is the maximum potential necessary to prevent fogging, is also lowered. Accordingly, the generation of fogging can be prevented.

In the present embodiment, the printer power source is left on during the period when the printer is idle, but the printer power source can be composed of a secondary power source such as a battery and a primary power source such as a commercial power source, so that even in a case where the primary power supply is off, electricity is provided by the secondary power supply so that the timer 25 can operate.

Second Embodiment

Next, the second embodiment of the present invention will be explained. Parts having the same construction as those described in the first embodiment are given the same number and an explanation thereof is omitted. The effect of the invention brought about by having the same structure of the first embodiment is incorporated in the same embodiment. Further, the structure of the printer according to the present embodiment is the same as that of the printer according to the first embodiment and therefore is described referencing FIG. 2.

Figure 6:
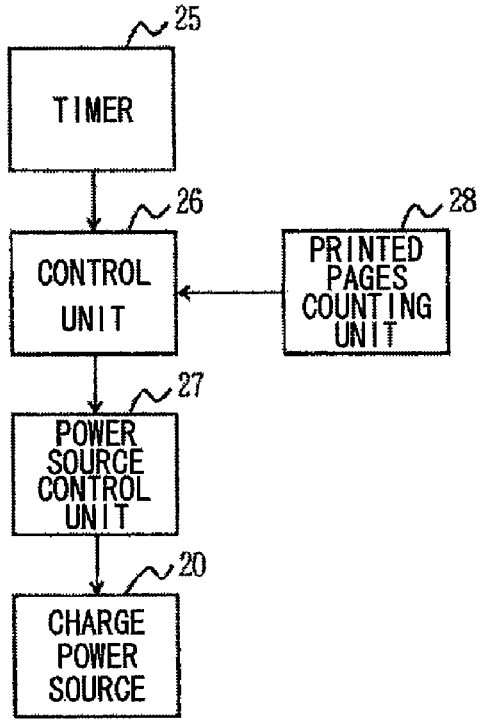
FIG. 6 is a block diagram showing the controls of the printer according to a second embodiment of the present invention.
Figure 7:
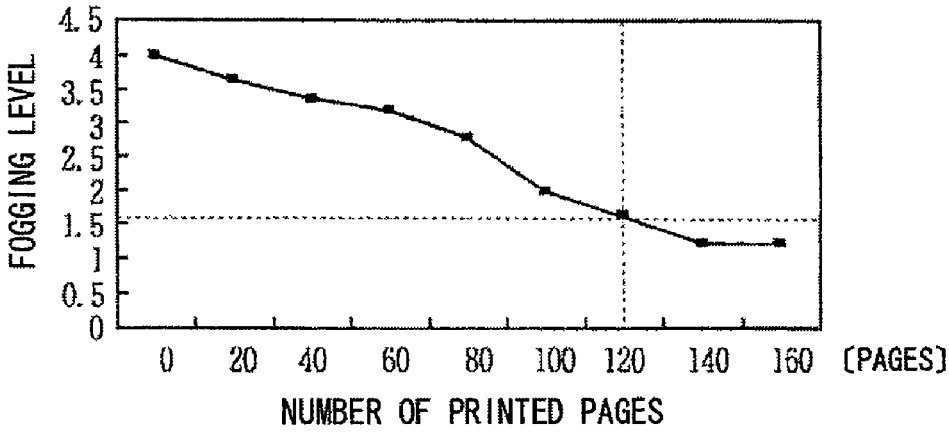
FIG. 7 is a diagram showing the change of the fogging level after the printer is idle.

FIG. 6 is a block diagram showing the controls of the printer according to the second embodiment of the present invention. FIG. 7 is a diagram showing the change of the fogging level after the printer is idle. In FIG. 7, the horizontal axis represents the number of pages printed and the vertical axis represents the fogging level.

In FIG. 6, numeral 28 is a printed pages counting unit serving as a counting unit for counting the number of printed pages representing the number of times the image is formed. A page number calculation process section, not shown, of the control unit 26 executes a page number calculation process to order the printed pages counting unit 28 to execute counting, to read the count value counted by the printed pages counting unit 28, and to calculate the number of printed pages.

In a case where printing is initiated after the printer is idle for a long period of time, as shown in FIG. 7, the fogging level decreases as the number of printed pages increases. When the number of printed pages reaches a prescribed value, for example, 120 pages, the fogging level reaches a point that is acceptable in terms of image quality. In addition, in a case where printing is initiated after the printer is idle for a long period of time, the surface potential v0 is set to a value $\alpha$2, which is lower than the reference value $\alpha$1, and when the number of printed pages reaches a set value m, the surface potential v0 is set to a reference value $\alpha$1.

Figure 8:
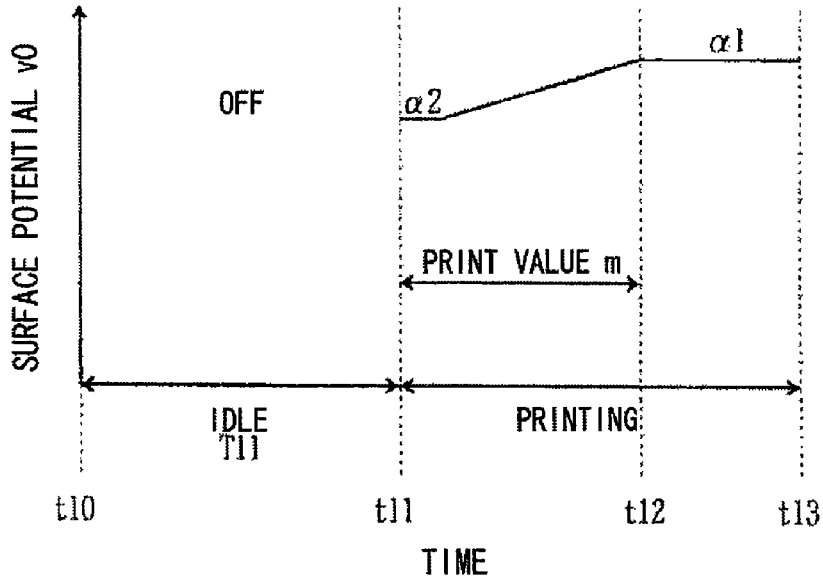
FIG. 8 is a time chart showing the performance of the printer according to the second embodiment of the present invention.

FIG. 8 is a time chart showing the performance of the printer according to the second embodiment of the present invention.

As shown in FIG. 8, printing is completed at a time t10, and the printer is idle if there is no print job sent from an external source such as a host apparatus.

The idle time calculation process section initiates time measurement by the timer 25 and completes the time measurement when printing is initiated at a time t11. T11, which is the time from t10 to t11 when the printer is idle, is then calculated.

Next, the idle time judgment process section makes a judgment as to whether the idle time period T11 is long based on whether T1 is above the previously set threshold Tth. In such a case, because the idle time period T11 is greater than the threshold Tth and is long, the surface potential setting process section sets the surface potential v0 to $\alpha$2, which is lower than the reference value $\alpha$1.

Next, printing is executed in the time period between the times t11 and t13, and the page number calculation process section initiates counting by the printed pages counting unit 28 at the time t11 and calculates the number of printed pages. The surface potential setting process section changes the surface potential v0 to the reference value $\alpha$1 through a prescribed pattern in a manner to set the surface potential v0 to the reference value $\alpha$1 at a time when the number of printed pages reaches the set value m.

In the present embodiment, in the aforementioned pattern, the surface potential v0 is set to the value $\alpha$2 at the time t11, and then after the passage of a prescribed amount of time, the surface potential v0 is temporarily raised and set to the reference value $\alpha$1 at the time t12 at which the number of printed pages reaches the prescribed value m. To realize this setting, a pattern generation process section of the surface voltage setting process section executes a pattern generating process to set and generate a pattern that changes the surface potential v0 for a time period between t11 and t12 based on the value $\alpha$1, the value $\alpha$2, and the like. In the present embodiment, the surface potential v0 changes linearly over time, but can also change in a manner such as a curved or stepped manner using other prescribed functions.

In the present embodiment, in a case where the surface potential v0 is changed after the printer is idle, generation of blurring caused by toner on the development roller 14 can be prevented because the surface potential v0 can be returned to the reference value $\alpha$1 by printing a certain number of pages in a case where the potential of the toner layer making up the potential v1 is increased by repeated printing.

In addition, in the present embodiment, the surface potential v0 is increased according to the number of printed pages but can also be increased according to the printing time. In such a case, a printing time calculation process section, not shown, of the control unit 26 initiates time measurement by the timer 25 at the time t11 and calculates the printing time. The surface potential setting process section then, along with the passage of printing time, changes the surface potential v0 to the reference value $\alpha$1 according to the prescribed pattern.

Third Embodiment

Next, the third embodiment of the present invention will be explained. Parts having the same construction as those described in the first and second embodiments are given the same number and an explanation thereof is omitted. The effect of the invention brought about by having the same structure of the first and second embodiment is incorporated in the same embodiment. Further, the structure of the printer according to the present embodiment is the same as that of the printer according to the first embodiment and therefore is described referencing FIG. 2.

Figure 9:
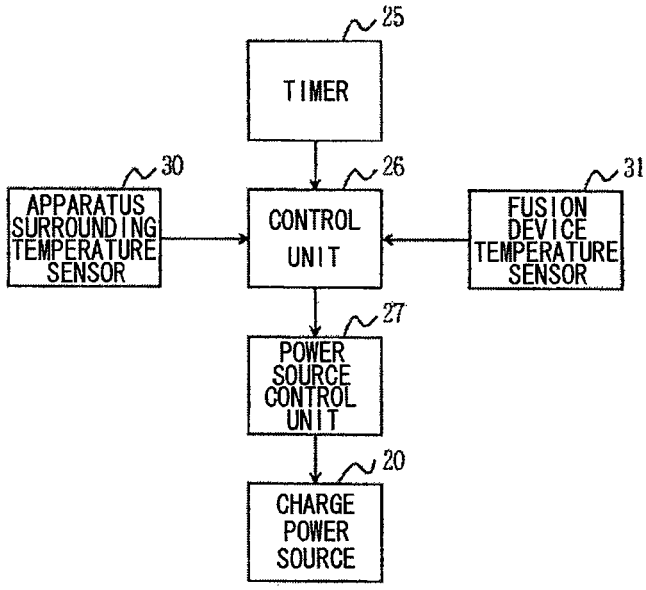
FIG. 9 is a block diagram showing the controls of the printer according to a third embodiment of the present invention.

FIG. 9 is a block diagram showing the controls of the printer relating to the third embodiment of the present invention.

In FIG. 9, numeral 30 is an apparatus surrounding temperature sensor for detecting the environment in which the printer is placed, which, in the case of the present embodiment, is the surrounding temperature of the apparatus, namely the surrounding temperature of the printer. Further, numeral 31 is a fusion device temperature sensor for detecting the fusion device temperature. In addition, the apparatus surrounding temperature sensor 30 and the fusion device temperature sensor 31 make up a temperature detection unit.

In the present embodiment, each toner making up the toner image on the paper P is affixed to the paper P by being heated, melted, and pressed to the paper P after being sent to the fusion device. Because of this, the fusion device contains a heating roller serving as a primary rotating body made up of aluminum, iron, or the like and a pressure roller serving as a secondary rotating body, and the heating roller contains a heating body such as a halogen lamp, for example. In addition, a fusion device containing a heating body such as a halogen lamp can also be used inside the belt.

A fusion device temperature is set within a prescribed temperature range, such that fusion cannot be executed when the temperature is too low, and adequate fusion cannot be executed when the temperature is too high because the toner cannot be affixed to the heating roller. Therefore, the fusion temperature sensor 31 is disposed facing the heating roller.

Figure 10:
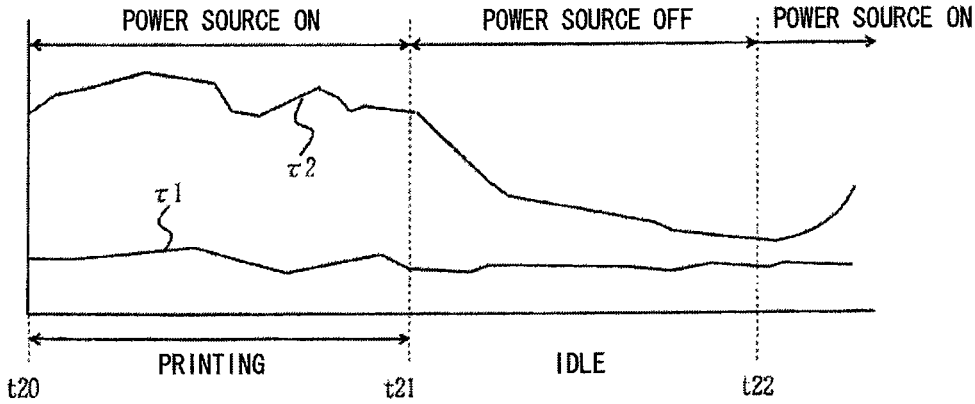
FIG. 10 is a time chart showing the performance of the printer according to the third embodiment of the present invention.

FIG. 10 is a time chart showing the performance of the printer according to the third embodiment of the present invention.

Here, the present embodiment is described in a case where the printer does not contain a secondary power source such as a battery, but rather the user turns the power source off after using the printer.

In FIG. 10, reference $\tau$1 is the surrounding temperature of the apparatus and reference $\tau$2 is the fusion device temperature. As shown in FIG. 10, in a case where the power supply is turned on and printing is executed in the period of time between t20 and t21, the fusion device temperature $\tau$2 becomes a high temperature (for example, 160 degrees Celsius), which is sufficiently higher than the surrounding temperature of the apparatus $\tau$1.

For example, when printing is completed at the time t21 and the user turns off the power supply, the surrounding temperature $\tau$1 of the apparatus does not change significantly, but the fusion device temperature $\tau$2 gradually decreases. In addition, the amount by which the fusion device temperature $\tau 2$ decreases is determined by heat capacity of the heating roller of the fusion device or the like.

Next, when the power source of the printer is turned on by the user at the time t22, a temperature difference calculation process section, not shown, of the control unit 26 executes a temperature difference calculation process to read the surrounding temperature $\tau 1$ of the apparatus and the fusion device temperature $\tau 2$ from the apparatus surrounding temperature sensor 30 and the fusion temperature sensor 31, respectively, and to calculate the temperature difference $\Delta\tau$ ($\Delta\tau=\tau 2-\tau 1$) by subtracting the surrounding temperature $\tau 1$ of the apparatus from the fusion device temperature $\tau 2$.

Next, an idle time inference process section, not shown, of the control unit 26 executes an idle time inference process to make a judgment as to whether the temperature difference $\Delta\tau$ is less than or equal to a previously set threshold $\tau$th, and in a case where the temperature difference $\Delta\tau$ is less than a previously set threshold $\tau$th, infers that the time that has passed since the power source was turned off, in other words, the idle time, is greater than the threshold Tth and makes a judgment that the idle time period is long. In the same manner as the first embodiment, the surface potential setting process section then sets the surface potential v0 to value $\alpha 2$, which is lower than the reference value $\alpha 1$.

On the other hand, in a case where the temperature difference $\Delta\tau$ is greater than a previously set threshold $\tau$th, the idle time inference process section infers that the idle time is less than the threshold Tth, and makes a judgment that the idle time period is short. In the same manner as the first embodiment, the surface potential setting process section then sets the surface potential v0 to the reference value $\alpha 1$.

In the present embodiment, in a case where the printer does not contain a secondary power source, the generation of fogging can be prevented even if the printing is completed and the user turns the printer power supply off, because a judgment can be made as to whether the idle time period is short.

Each of the previous embodiments was described as pertaining to a printer, but the present invention can also be applied to fax machines, copy machines, and multifunction devices.

Further, each of the previous embodiments was described as pertaining to a case where direct voltage is applied to the charge roller 12 by the charge power source 20, but alternating voltage superimposed on direct voltage can also be applied to the charge roller 12.

Yet further, each of the previous embodiments was described as pertaining to a case where the charge roller 12 is used as a charge device, but a blade, brush (including magnetic brushes), or the like can also be used as the charge apparatus.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus, comprising:

an image holding body;

a developer holding body for holding developer that forms a developer image by being affixed to an electrostatic latent image formed on said image holding body;

a transfer unit for transferring the developer image to a medium;

a fusion apparatus for fusing the transferred developer image onto said medium;

an idle time process measuring unit for measuring an idle time, from when printing is completed to when printing is initiated, of said image forming apparatus; and a control unit configured to set a surface potential of the image holding body to a first value at the time of image forming when the idle time is shorter than a predetermined duration, and to set the surface potential of the image holding body to a second value at the time of image forming when the idle time is longer than the predetermined duration, the second value being less than the first value.

2. The image forming apparatus according to claim 1, wherein the control unit controls a charge potential source for charging the surface of the image holding body to the first value at the time of image forming when the idle time is shorter than the predetermined duration and to the second value at the time of image forming when the idle time is longer than the predetermined duration.

3. The image forming apparatus according to claim 1, wherein the control unit is configured to, after the surface potential of the image holding body is set to the second value, change the surface potential to the first value from the second value once a threshold number of printed pages or a threshold printing time is achieved.

4. The image forming apparatus according to claim 1, further comprising a temperature detection unit for detecting a fusion device temperature expressing a temperature of a fusion device and an apparatus surrounding temperature representing a temperature surrounding said image forming apparatus, wherein said idle time measuring process unit measures the idle time as longer than the predetermined duration where a temperature difference between the apparatus surrounding temperature and the fusion device temperature is greater than a threshold value.

5. The image forming apparatus according to claim 1, wherein the idle time from when printing is completed to when printing is initiated is a time during which a print job is not received from an upper level apparatus.

6. The image forming apparatus according to claim 1, further comprising a secondary power source for providing power to said image forming apparatus in a case where a main power source is turned off.

* * * * *